US005232182A

United States Patent [19]

Hamilton

[11] Patent Number: 5,232,182

[45] Date of Patent: Aug. 3, 1993

[54] AUTONOMOUS SYSTEM FOR INITIALIZING SYNTHETIC APERTURE RADAR SEEKER ACQUISITION

[75] Inventor: Paul C. Hamilton, Acton, Mass.

[73] Assignee: The United States of America as represented by the Secretary of the Air Force, Washington, D.C.

[21] Appl. No.: 440,390

[22] Filed: Oct. 27, 1982

[51] Int. Cl.[5] ..... F41G 7/28

[52] U.S. Cl. ..... 244/3.19

[58] Field of Search ..... 244/3.15, 3.19, 3.14

[56] References Cited

U.S. PATENT DOCUMENTS

| | | | |
|---|---|---|---|
| 3,018,981 | 1/1962 | Weller | 244/14 |
| 3,415,465 | 12/1968 | Bedford | 244/3.14 |
| 4,108,400 | 8/1978 | Groutage et al. | 244/3.19 |
| 4,142,695 | 3/1979 | Remmell et al. | 244/3.14 |
| 4,216,472 | 8/1980 | Albanese | 343/7.3 |
| 4,264,907 | 4/1981 | Durand, Jr. et al. | 343/6 ND |
| 4,274,609 | 6/1981 | Ferrier et al. | 244/3.14 |

*Primary Examiner*—Charles T. Jordan

*Attorney, Agent, or Firm*—Stanton E. Collier; Donald J. Singer

[57] ABSTRACT

A method of guiding an air-to-air missile launched from a penetrating aircraft at a target aircraft having a search radar therein is shown. The missile changes from a passive antiradiation homing mode to an active seeker mode when the missile is detected and the search radar is shutdown. The active seeker uses a synthetic aperture radar that is squinted at the target aircraft. At the hand-over point when the search radar is shutdown, the missile executes a turn away from the target aircraft to bring the target aircraft within the synthetic aperture radar coverage. The amount of turn is within preselected limits based on several parameters.

2 Claims, 3 Drawing Sheets

SQUINT ACQUISITION HORIZONTAL PLANE

SQUINT MODE, MISSILE TURN ANGLE

AUTONOMOUS SYSTEM FOR INITIALIZING SYNTHETIC APERTURE RADAR SEEKER ACQUISITION

STATEMENT OF GOVERNMENT INTEREST

The invention described herein may be manufactured and used by or for the Government for governmental purposes without the payment of any royalty thereon.

BACKGROUND OF THE INVENTION

This invention relates generally to guided missiles, and in particular to the guidance system of air-to-air guided missiles. In greater particularity, this invention provides a system for determining missile guidance during the handover from the passive to active tracking mode.

Upon the detection of a search radar beam from an aircraft having such an aircraft warning system therein having air-to-air guided missiles, the aircraft launches a guided missile at the target aircraft having the search radar. It is assumed that the target aircraft has not detected the bomber in the following scenario. This situation can easily occur if the bomber is flying near the deck to avoid detection from both land based radar and/or aircraft radar. The detection of the search radar from the target aircraft can occur at a distance well beyond the detection range of the search radar because of the required return energy level needed to identify the bomber. The bomber may be only one of an attacking group and certainly desires to disable the target aircraft before detection of itself or other bombers within the group. Further, it is highly desireable for the bomber to remain close to the ground as possible to avoid additional detection by land based radar. Therefore, as soon as the search radar is detected, the bomber launches an air-to-air guided missile. Because of the great range between the bomber and the target aircraft, the guided missile will remain undetected for a longer time due to the much smaller radar cross section. To minimize the distance at which the guided missile is detected, the guided missile can be flown to a much higher altitude to avoid detection by the main lobe of the search radar. The target aircraft probably is aware of such a scenario and thus would scan periodically higher altitudes.

The initial coordinates of the target aircraft are fed to the missile guidance system at launch and then the guided missile executes the low-to-high altitude maneuver and tracks passively the search radar's side lobes until transmission is halted. At this point, the guided missile must start active seeker mode tracking. Detection of the guided missile by the target aircraft may occur at distances of fifty miles or greater. This distance clearly limits the active seeker of the guided missile. Optical tracking is not feasible because of the great distance and thus radar tracking is required although still limited because of range.

SUMMARY OF THE INVENTION

The present invention sets forth a method of missile guidance that thereby overcomes the problems noted hereinabove. To minimize radar weight and maximize radar performance, it has been determined that synthetic aperture radar provides the needed capability since the target aircraft may be up to fifty miles or more from the guided missile when the search radar is turned off to avoid passive tracking by the missile. Operating in an active seeker mode by the synthetic aperture radar requires that the missile's radar be squinted at an angle from the missile's flight path. The problem of turning the missile at the handover point when the search radar of the target aircraft is halted has been a concern.

The guided missile has a conventional guidance system including an antiradiation homing (ARH) seeker, an active seeker, a seeker computer and controller, and a flight control computer. The ARH is used in the initial and midcourse stages of the flight when the target aircraft's radar is operating in its normal surveillance mode. The active seeker is used in the terminal stage of the flight which begins when the target aircraft shuts down its radar because of the guided missile. The transistion from the midcourse to the terminal stage occurs at the time of radar shut-down. Because the active seeker operates in a squint mode required by the synthetic aperture radar, the guided missile must make changes in its flight path to adjust for the active mode versus the passive seeker mode. Desired signals, versus jamming type signals, are passed from the seekers to a seeker computer. The seeker computer controller has determinants stored therein for distinguishing interrogating pulses of the target aircraft from jamming type pulses and inhibits the transmission of jamming pulses to the seeker computer. A seeker computer controller activates the seeker during the appropriate stages of the flight. Initial guidance commands are fed to the seeker computer controller from the bomber or releasing aircraft and further guidance information such as position and altitude are provided by the flight control computer. The flight control computer also provides guidance commands to the missile's autopilot.

The seeker computer based upon coordinates of the guided missile and the bomber at radar shutdown determines, for example, the shutdown range. If the shutdown range is less than one hundred miles, for example, the seeker computer determines various parameters such as squint angle of the active seeker antenna missile velocity, altitude, target velocity and position, minimum and maximum target intercept ranges, and the optimum and maximum turn angles. Some of these parameters are transmitted to the autopilot for execution. Based upon the geometry and the kinematics, an optimum turn angle as defined by equation 1 and a maximum turn angle as defined by equation 2 control the terminal guidance of the guided missile to the target aircraft; the variables are detailed in the preferred embodiment.

$$\alpha T_{MIN} = \tan^{-1}(B/A) + \sin^{-1}(A^2+B^2)^{-\frac{1}{2}} \quad (1)$$

$$\alpha T_{MAX} = \sin^{-1}(C^2+D^2)^{-\frac{1}{2}} - \tan^{-1}(C/D) \quad (2)$$

It is therefore one object of this invention to provide for a method of guiding a missile to a target;

It is a further object of this invention to provide for a method of guiding an air-to-air missile to a target aircraft having a radar that changes from an active search radar to a shutdown radar;

It is another object of this invention to provide for a method of guiding an air-to-air missile having a synthetic aperture radar to a target aircraft with a shutdown search radar.

These and many other objects and advantages of the present invention will be apparent to one skilled in the art from the following detailed description of a preferred embodiment of the invention and claims when considered in conjunction with the drawings.

DETAILED DESCRIPTION OF THE PREFERRED EMBODIMENT

Figure 1:
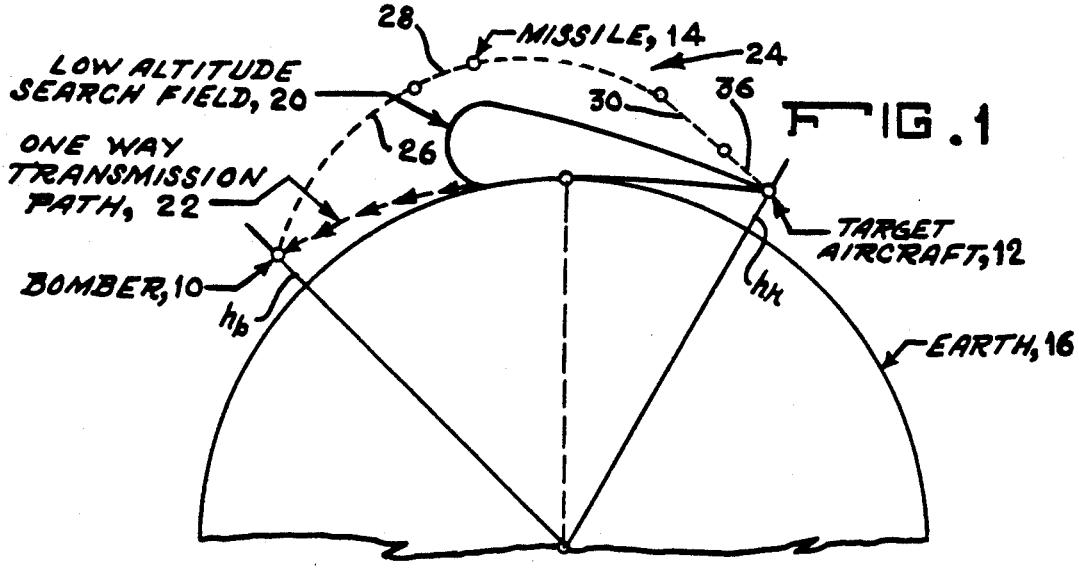
FIG. 1 is a pictorial representation of the battle engagement scenario using a guided missile employing the method of this invention.

Referring to FIG. 1, the engagement scenario between preferrably a bomber 10, although other aircraft capable of carrying an air-to-air guided missile is feasible, and a target aircraft 12 having a surveillance radar 18 (not shown) therein is illustrated. A low altitude search field 20 from radar 18 is scanning a horizon over an Earth 16 looking for an aircraft. Bomber 10 located a distance $h_b$ above Earth 16 detects radar energy traveling a one-way transmission path 22. Any radar energy reflected by bomber 10 returning to aircraft 12, if possible, because of multi-paths, etc., will be undetectable because of the distance from the source. Upon detection of target aircraft 12, bomber 10 launches an air-to-air guided missile 14 to eliminate target aircraft 12. Evasive action by missile 14, as well as having a much smaller radar cross section, insures a close approach, about on the order of 50 miles, to aircraft 12 before detection of missile 14. It is assumed that aircraft 12 has a high altitude search radar capability otherwise passive homing would be effective up to a very close range wherein aircraft 12 would not be able to make evasive maneuvers. Target aircraft 12 is assumed to be an AWACS type of aircraft thus having limited maneuverability. This would require an effective air-to-air guided missile search radar assumed to exist on aircraft 12.

A flight profile 24 of missile 14 has several stages: (a) on launching, missile 14 climbs quickly to a high altitude such as 10 to 15 miles along an ascent path 26 and then pitches over to a course corresponding to the bearing of surveillance radar 18; (b) in a midcourse stage after pitchover, missile 14 flies on a pursuit path 28 toward radar 18 maintaining altitude and changing course only to maintain a relative bearing (in azimuth) of zero. A passive seeker 32, shown in FIG. 3, in missile 14 provides tracking information during pursuit; (c) upon detection and the shutdown of radar 18, a terminal stage is initiated bv missile 14. Missile 14 then follows a terminal path 30 during which time an active seeker 34 tracks target aircraft 12; and (d) finally initiating an intercept, missile 14 follows a proportional navigation intercept path 36 as determined by signals from an active seeker 34, shown in FIG. 3.

The transition from the passive midcourse phase along pursuit path 28 to the terminal phase along terminal path 30 requires that missile 14 search for relatively slowly moving surveillance radar 18 in target aircraft 12 in a mainlobe, look-down clutter environment. The Doppler beam sharpening capability (azimuth resolution) inherent in a synthetic aperture radar (SAR) makes it desirable to operate active seeker 34 in a SAR mode while attempting to acquire target aircraft 12.

Referring to FIG. 2, FIG. 2 illustrates the kinematic geometry in the horizontal plane that allows active seeker 34 to be operated in the synthetic aperture mode.

Seeker antenna 35, not shown, is squinted through an angle, $\theta_S$, with respect to the missile velocity vector, $VM_2$, in order that seeker antenna 35 pattern sweeps through the entire target uncertainty volume as missile 14 travels along terminal path 30. A missile azimuth turn angle, $\alpha_T$, through which the missile must be turned at radar shutdown is a critical parameter which must be selected using the following criteria: (a) target aircraft 12 cannot cross over the new flight path of missile 14; (b) the minimum possible range at which active seeker 34 may acquire target aircraft 12 is consistent with missile's 14 maneuver capability to perform an intercept after acquisition; and (c) the maximum target acquisition range of the active seeker 34 is not exceeded at any time during the target search (acquisition) mode.

Figure 2A:
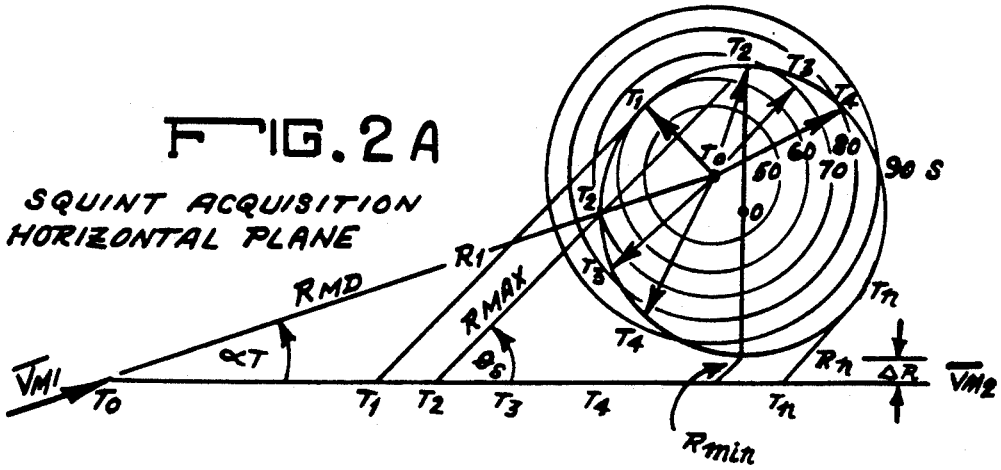
FIG. 2A is a plan view of the horizontal plane showing the geometrics of the engagement scenario of FIG. 1.

Referring to FIG. 2A, the relative missile 14/target aircraft 12 geometry in a horizontal plane at the time of shutdown of surveillance radar 18 is illustrated. Since it is assumed that target aircraft 12 can take any heading after time $t_o$, the time of surveillance radar 18 shutdown, it may be seen that the locus of missile-to-target range for a line-of sight angle equal to the seeker squint angle is a circle offset from the initial target position. The maximum missile-to-target range, $R_{MAX}$, and the minimum missile-to-target range, $R_{MIN}$, occur at opposite ends of the vertical diameter of this circle. An approximate solution can be derived by ignoring the offset as shown in FIG. 2B and solving for $R_{MAX}$ and $R_{MIN}$ as if they occurred on a vertical diameter of the target position versus time locus.

Figure 2B:
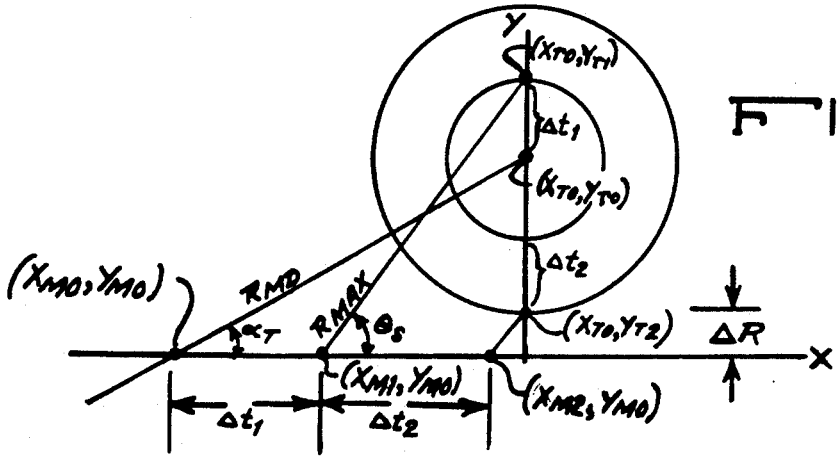
FIG. 2B is an approximation of FIG. 2A.

Referring to FIG. 2B, the geometry involved with this approximate solution is illustrated. The time $t_o$ is defined as the initial time (corresponding to the time of shut-down of the surveillance radar 18 and of missile 14 turn through angle, $\alpha_T$); time $t_1$ corresponds to the time of occurrence of maximum acquisition range, $R_{MAX}$; a time $t_2$ is the time of occurence of minimum acquisition range, $R_{MIN}$. The following basic equations are obtained from FIG. 2B:

$$R_{MAX} = \frac{X_{MO} - V_M\Delta t_1}{\cos\theta_S} = \frac{R_{MD}\cos\alpha_T - V_M\Delta t_1}{\cos\theta_S} \quad (3)$$

and also:

$$R_{MAX} = \frac{Y_{TO} + V_T\Delta t_1}{\sin\theta_S} = \frac{R_{MD}\sin\alpha_T + V_T\Delta t_1}{\sin\theta_S} \quad (4)$$

Equating equations (3) and (4) and solving for $t_1$ results in:

$$V_T\Delta t_1\cos\theta_S + V_M\Delta t_1\sin\theta_S = R_{MD}(\cos\alpha_T\sin\theta_S - \sin\alpha_T\cos\theta_S) \quad (5)$$

$$\Delta t_1 = \frac{R_{MD}\sin(\theta_S - \alpha_T)}{V_T\cos\theta_S + V_M\sin\theta_S} \quad (6)$$

$$R_{MAX} = \frac{R_{MD}\left[\cos\alpha_T - \left(\frac{V_M\sin(\theta_S - \alpha_T)}{V_T\cos\theta_S + V_M\sin\theta_S}\right)\right]}{\cos\theta_S} \quad (7)$$

The solution for $R_{MIN}$ is derived in a similar manner:

$$X_{M2}=X_{MO}-V_M(\Delta t_1+\Delta t_2)=R_M\cdot D\cos\alpha_T-V_M\Delta t_1-V_M\Delta t_2 \quad (8)$$

$$Y_{T2}=Y_{TO}-V_T(\Delta t_1+t_2)=\Delta R \quad (9)$$

From FIG. 2B it is apparent that:

$$Y_{T2}=R_{MD}\sin\alpha_T-V_T(\Delta t_1+\Delta t_2) \quad (10)$$

Since $$R_{MIN}=\frac{Y_{T2}}{\sin\theta_S}=\frac{Y_{M2}}{\cos\theta_S} \quad (11)$$

it is possible to equate these expressions to solve for $t_2$:

$$R_{MD}\left[\cos\alpha_T-\frac{V_M}{V_T}\left(\frac{\sin(\theta_S-\alpha_T)}{\cos\theta_S+(V_M/V_T)\sin\theta_S}\right)\right]-V_M\Delta t_2= \quad (12)$$

$$R_{MD}\left[\sin\alpha_T-\frac{V_T}{V_M}\left(\frac{\sin(o_S-\alpha_T)}{(V_T/V_M)\cos\theta_S+\sin\theta_S}\right)\right]-V_T\Delta t_2$$

Letting a equal the term in the first set of brackets in equation (12) and b equal the term in the second set of brackets:

$$\frac{R_{MD}a-V_M\Delta t_2}{\cos\theta_S}=\frac{R_{MD}b-V_T\Delta t_2}{\sin\theta_S} \quad (13)$$

and therefore:

$$\Delta t_2=\frac{R_{MD}(a\sin\theta_S-b\cos\theta_S)}{V_M\sin\theta_S-V_T\cos\theta_S} \quad (14)$$

From equations (8) and (11)

$$R_{MIN}=\frac{R_{MD}\cos\alpha_T-V_M(\Delta t_1+\Delta t_2)}{\cos\theta_S} \quad (15)$$

Equation (6) gives the expression for $\Delta t_1$ and combining results in:

$$R_{MIN}=\frac{R_{MD}\cos\alpha_T-V_M\left(\frac{R_{MD}\sin(\theta_S-\alpha_T)}{V_T\cos\theta_S+V_M\sin\theta_S}\right)}{\cos\theta_S}+\frac{\frac{R_{MD}(a\sin\theta_S-b\cos\theta_S)}{V_M\sin\theta_S-V_T\cos\theta_S}}{\cos\theta_S} \quad (16)$$

$$R_{MIN}=\frac{R_{MD}a-V_M\Delta t_2}{\cos\theta_S} \quad (17)$$

Where:

$a=\cos\alpha_T-V_Mc$ $b=\sin\alpha_T-V_Tc$ $$c=\frac{\sin(\theta_S-\alpha_T)}{V_T\cos\theta_S+V_M\sin\theta_S}$$

$$\Delta t_2=\frac{R_{MD}(a\sin\theta_S-b\cos\theta_S)}{V_M\sin\theta_S-V_T\cos\theta_S}$$

It should be noted here that equations (7) and (17) solve for ground plane ranges. However, since missile 14 and target aircraft 12 may be displaced significantly in altitude, the foregoing solutions must be modified to reflect this effect.

$$R_{SLANT}=\frac{R_{ground\ plane}}{\cos\psi} \quad (18)$$

where:

$$\psi=\tan^{-1}\left(\frac{\Delta h}{R_{ground\ plane}}\right) \quad (19)$$

Having derived expressions for $R_{MAX}$ and $R_{MIN}$ it can be shown that the recommended missile turn angle, $\alpha_T$, can be approximated by:

$$\alpha T_{MIN}=\tan^{-1}(B/A)+\sin^{-1}(A^2+B^2)^{\frac{1}{2}} \quad (20)$$

where:

$$B=R\sin(\tan^{-1}B/A)=\frac{R_{MD}}{R_{MIN}}\left[\frac{V_T}{V_M\sin\theta_S-V_T\cos\theta_S}\right] \quad (21)$$

$$A=R\cos(\tan^{-1}B/A)=\frac{R_{MD}}{R_{MIN}}\left[\frac{V_M}{V_M\sin\theta_S-V_T\cos\theta_S}\right] \quad (22)$$

$$R=(A^2+B^2)^{\frac{1}{2}} \quad (23)$$

and:

$R_{MD}$=missile-to-target range at time of radar shutdown $R_{MIN}$=minimum permissible acquisition range to effect an intercept $V_T$=maximum target velocity $V_M$=missile velocity $\theta_S$=missile antenna squint angle If target aircraft 12 does not dash toward missile 14, thereby forcing a minimum intercept problem, but instead runs at a heading that forces missile 14 to acquire aircraft 12 at the maximum possible range, then a second value of missile turn angle, $\alpha T_{MAX}$ is of interest. The angle, $\alpha T_{MAX}$, is defined as the maximum value of the turn angle that the missile 14 can execute and still have sufficient radar range capability to acquire the fleeing target 12. The angle, $\alpha T_{MAX}$, is computed as follows:

$$\alpha T_{MAX}=\sin^{-1}(C^2+D^2)^{\frac{1}{2}}-\tan^{-1}C/D \quad (24)$$

where:

$$C=\left(1-\frac{V_M\sin\theta_S}{V_M\sin\theta_S+V_T\cos\theta_S}\right)\left(\frac{R_{MD}}{R_{RDR}\cos\theta_S}\right) \quad (25)$$

$$D=\frac{V_M R_{MD}}{R_{RDR}(V_M\sin\theta_S+V_T\cos\theta_S)} \quad (26)$$

and $R_{RDR}$ is the maximum missile radar acquisition range capability.

The missile-to-target range, $R_{MD}$, at the time of the radar shutdown is computed utilizing triangulation in the elevation plane as is described in patent application Ser. No. 116,112, filed on 21 Jan. 1980 by Hamilton et al which is hereby incorporated by reference.

Figure 3:
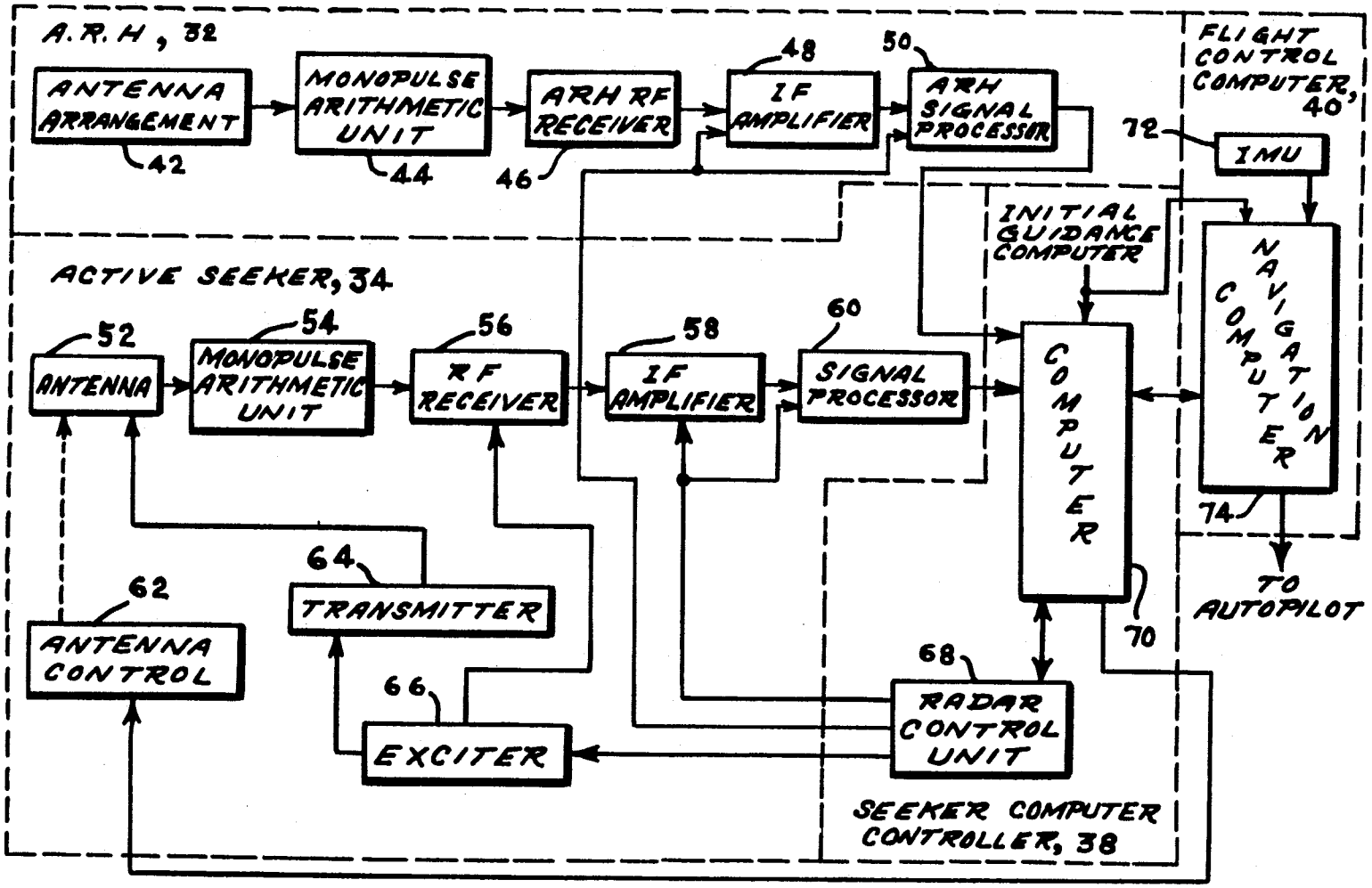
FIG. 3 is an electronic functional block diagram of a guided missile's guidance system of this invention.

Referring to FIG. 3, an electronic block diagram of the contemplated air-to-air guidance system in missile 14 is shown to include antiradiation homing seeker (ARH) 32, active seeker 34, a seeker computer and controller 38 and a flight control computer 40. ARH 32 is used in the initial and midcourse stages of flight of missile 14 when radar 18 is operating in normal surveillance mode. Active seeker 34 is used in the terminal stage of flight of missile 14 after the missile has been detected, radar 18 then being shutdown to render the ARH 32 ineffective.

The ARH 32 includes an antenna arrangement 42 such as a monopulse antenna (or antennas) covering the frequency band (or bands) of interest and a monopulse arithmetic unit 44 to produce sum (Σ) and difference (Δ) signals from each received signal in the band (or bands) of interest. Such Σ and Δ signals are applied to an ARH radio frequency (R.F.) receiver 46.

In the contemplated engagement scenario extraneous signals as, for example, from jamming sources (not shown) together with the signals from radar 18 will enter ARH RF receiver 46. However, with an a priori knowledge of a number of distinguishing parameters of the interrogating pulses from radar 18, such pulses may be distinguished in a conventional manner by comparing each received pulse, or set of pulses, with determinants stored in seeker computer and controller 38 to separate interrogating pulses of interest from any extraneous input signals. Determinants which may be used by seeker computer controller 38 include, but are not limited to, the following: angles of arrival in azimuth and elevation, amplitude, and pulse width. These discriminants may be represented by corresponding voltage levels and used by an ARH signal processor 50 to inhibit passage of undesired signals from the latter to seeker computer controller 38. ARH IF amplifier 48 is actuated by a control signal from a radar control unit 68 at all times during flight of the missile 14 until the terminal phase of flight when active seeker 34 is in operation. ARH IF amplifier 48 here incorporates double down conversion in each monopulse channel and quadrature detection to derive pitch and yaw signals which define the direction the source of each one of the received signals; ARH signal processor 50 inhibits conversion of all pitch and yaw signals (except those which could possibly be from the surveillance radar 18) to digital signals for further processing in a computer 70.

In addition to the inputs from the ARH signal processor 50, position and attitude signals from a conventional navigation computer 74 are fed into computer 70. Computer 70 and navigation computer 74 are provided with initial target position information from a computer (not shown) within the penetrating bomber 10 to set initial conditions and to designate the target before launch of missile 14. After launch, the outputs of navigation computer 74 are controlled in accordance with the outputs of a conventional inertial measurement unit (IMU) 72 and boresight error signals from computer 70. A conventional autopilot (not shown) may be actuated by signals from the navigation computer 74 to cause the missile 14 to follow a desired guidance mode during its flight toward target 12.

Table I relates data parameter and variable to the electronic block diagram of FIG. 3.

| Data | Source | Computation | End Use |
|---|---|---|---|
| $V_m$<br>$\Delta_t$<br>$\theta_o$ | IMU<br>Master Clock<br>ARH Receiver | $R_{md} = \frac{V_m \Delta_t}{\sin\theta_o}$ | $R_{min}$, $R_{max}$, $\alpha_t$ |
| $V_m$<br>$\eta_g$<br>$h_m$ | IMU<br>Computer Memory<br>Baro. Altimeter | $R_{min} = \text{Chord of Arc } \frac{V^2}{\eta_g}$ | $\alpha_t$, $R_{max}$, Range Gate Implementation |
| $V_t$<br>$\theta_s$<br>$V_m$<br>$\alpha_t$<br>$R_{md}$ | Computer Memory<br>Computer Memory<br>IMU<br>Computer<br>Computer | $R_{max} = \frac{R_{md}\left[\cos\alpha_t - \left(\frac{V_m \sin(\theta_s - \alpha_t)}{V_m \sin\theta_s + V_t \cos\theta_s}\right)\right]}{\cos\theta}$ | Range Gate Implementation |
| $R_{min}$<br>$R_{md}$<br>$V_m$<br>$\theta_s$<br>$V_t$<br>$\alpha_t$ | Computer<br>Computer<br>IMU<br>Computer Memory<br>Computer Memory<br>Computer | $\alpha_t \text{ opt} = \tan^{-1} B/A + \sin^{-1} \frac{1}{\sqrt{A^2 + B^2}}$<br>(See text for Def. of A, B) | Missile Turn CMD to Autopilot |
| $R_{max}$<br>$R_{md}$<br>$V_m$<br>$V_t$<br>$\theta_s$ | Computer<br>Computer<br>IMU<br>Computer Memory<br>Computer Memory | $\alpha_t \max = \sin^{-1} \frac{1}{\sqrt{C^2 + D^2}} - \tan^{-1} C/D$<br>* (See text for Def. of C, D) | Missile Turn CMD Limit to Autopilot |

Figure 4:
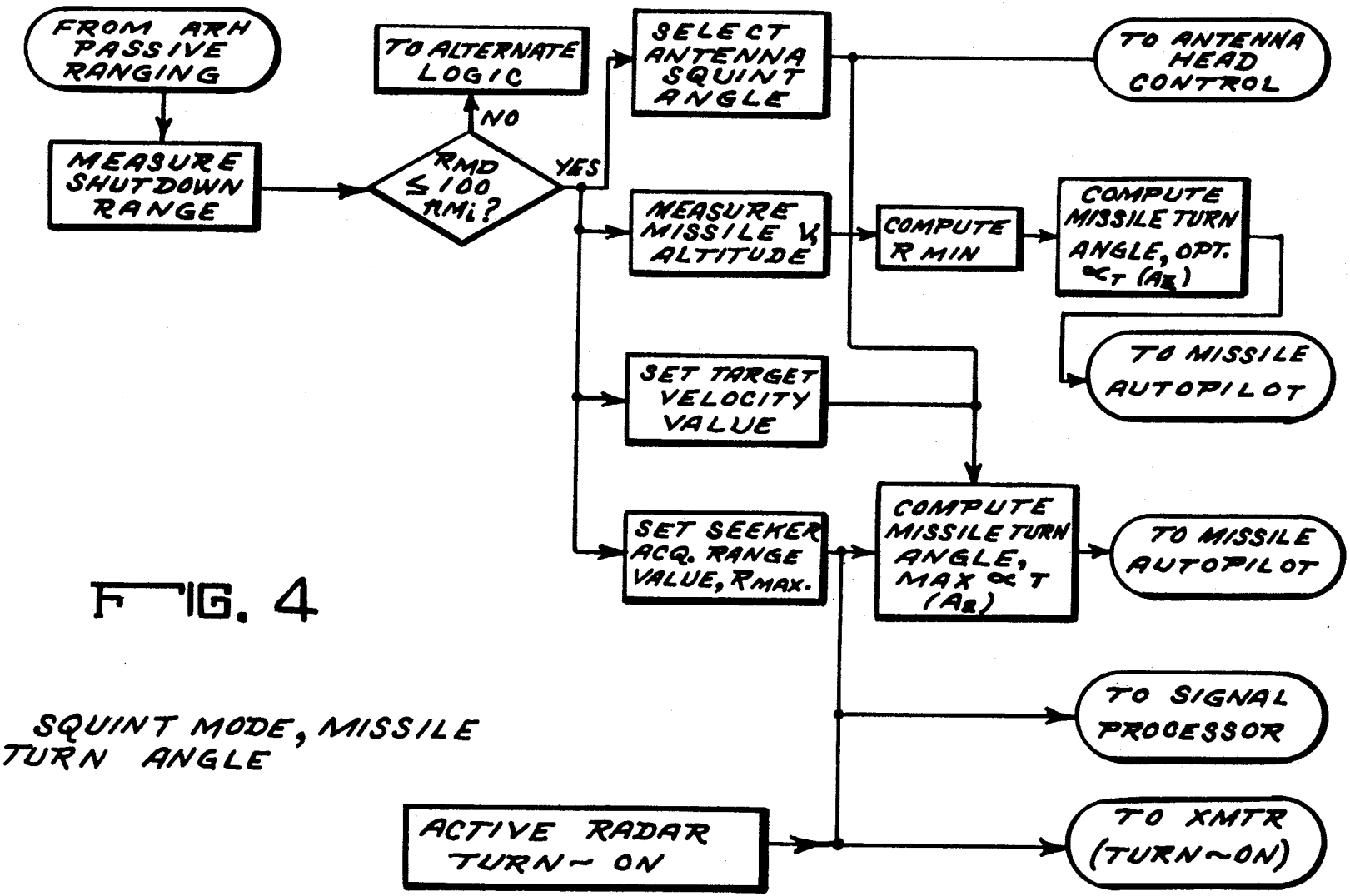
FIG. 4 is a logic diagram showing the use of turn angles used by the method of this invention.

A basic logic flow diagram used to compute the missile turn angle in the squint mode using SAR 8 is illustrated in FIG. 4.

The operation of missile 14 against an "AWACS" type target aircraft 12 is described in the summary of the invention.

Clearly, many modifications and variations of the present invention are possible in light of the above teaching and it is therefore understood that within the scope of the inventive concept, the invention may be practiced otherwise than specifically described.

What is claimed is:

1. A method of guiding a missile having an active seeker including a synthetic aperture radar operating in a squint mode to a target aircraft having a search radar therein the maximum range of active seeker acquisition being within said missile's maneuver capability to intercept, and the maximum range of active seeker acquisition not exceeding the capability of the active seeker, said method comprising the steps of:

launching said missile in response to detection of the search radar;

implementing a passive seeker mode of operation to passively guide said missile towards said target aircraft in a manner to avoid detection of said missile by said target aircraft;

transferring from said passive seeker mode to an active seeker mode in response to detected shutdown of said search radar;

maneuvering said missile to execute a turn angle away from said target aircraft such that the search field of said synthetic aperture radar sweeps through an entire target uncertainty volume, said turn angle being within a first preselected limit and a second preselected limit such that said target aircraft does not cross over said missile's terminal flight path; and intercepting said target aircraft within a lethal range of said missile.

2. A method of guiding a missile as defined in claim 1 wherein said first preselected limit is defined as $$\alpha T_{MIN} = \tan^{-1}(B/A) + \sin^{-1}(A^2+B^2)^{-\frac{1}{2}}$$

and said second preselected limit is defined as $$\alpha T_{MAX} = \sin^{-1}(C^2+D^2)^{-\frac{1}{2}} - \tan^{-1} C/D$$

where $$A = \frac{R_{MD}}{R_{MIN}}\left(\frac{V_M}{V_M \sin\theta_S - V_T \cos\theta_S}\right),$$

$$B = \frac{R_{MD}}{R_{MIN}}\left(\frac{V_T}{V_M \sin\theta_S - V_T \cos\theta_S}\right),$$

$$C = \left(1 - \frac{V_M \sin\theta_S}{V_M \sin\theta_S + V_T \cos\theta_S}\right)\left(\frac{R_{MD}}{R_{RDR} \cos\theta_S}\right),$$

$$D = \frac{V_M R_{MD}}{R_{RDR}(V_M \sin\theta_S + V_T \cos\theta_S)},$$

and $R_{MD}$=target radar shutdown range $R_{MIN}$=minimum permissible missile acquisition range to effect an intercept $R_{RDR}$=maximum missile radar acquisition range to effect an intercept $V_T$=target velocity (maximum)

$V_M$=missile velocity $\theta_S$=missile antenna squint angle.

* * * * *